US006319185B1

(12) United States Patent
Sohl

(10) Patent No.: US 6,319,185 B1
(45) Date of Patent: Nov. 20, 2001

(54) RESILIENT ROLL AND PROCESS FOR PRODUCING SUCH A ROLL

(75) Inventor: Carsten Sohl, Fredericia (DK)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/538,285

(22) Filed: Mar. 30, 2000

(30) Foreign Application Priority Data

Mar. 31, 1999 (DE) ..... 199 14 710

(51) Int. Cl.[7] ..... B31B 1/62

(52) U.S. Cl. ..... 493/467; 493/141; 493/144; 493/145

(58) Field of Search ..... 493/467, 144, 493/141, 145, 155, 337, 406, 471; 152/323, 393, 394; 492/49, 50, 51, 59, 54, 58, 56; 29/895.211, 895.3, 895.32, 130

(56) References Cited

U.S. PATENT DOCUMENTS

| | | | | |
|---|---|---|---|---|
| 3,406,248 | | 10/1968 | Bunish et al. . | |
| 3,467,009 | * | 9/1969 | Ross | 29/130 |
| 3,490,119 | * | 1/1970 | Fukuyama et al. | 29/130 |
| 3,514,312 | * | 5/1970 | Gardiner | 29/130 |
| 3,852,862 | | 12/1974 | Sukenik . | |
| 4,368,568 | * | 1/1983 | Watanabe | 29/130 |
| 4,466,164 | | 8/1984 | Tadokoro et al. . | |
| 4,631,793 | * | 12/1986 | Shintaku et al. | 492/50 |
| 4,940,445 | * | 7/1990 | DesPortes | 152/323 |
| 5,257,966 | * | 11/1993 | Watanabe et al. | 493/467 |
| 5,857,950 | * | 1/1999 | Hycner | 29/895.32 |
| 5,993,366 | * | 11/1999 | Kaji et al. | 492/56 |
| 6,142,203 | * | 11/2000 | Bickford | 152/323 |
| 6,148,170 | * | 11/2000 | McMindes et al. | 492/56 |
| 6,195,526 | * | 2/2001 | Lee et al. | 492/56 |

FOREIGN PATENT DOCUMENTS

| | | |
|---|---|---|
| 1807331 | 6/1970 | (DE) . |
| 1621821 | 10/1971 | (DE) . |
| 2128294 | 1/1973 | (DE) . |
| 2514294 | 10/1976 | (DE) . |
| 3029288 | 3/1981 | (DE) . |
| 3703564 | 8/1987 | (DE) . |
| 4339097 | 11/1994 | (DE) . |
| 19506301 | 8/1996 | (DE) . |
| 19511153 | 10/1996 | (DE) . |
| 19736575 | 3/1999 | (DE) . |

OTHER PUBLICATIONS

Gamsjager, "Elastiche Kalanderwalzenbezuge auf Basis Faser–Kunststoff–Verbund", *Das Papier*, H. 6(1994).

* cited by examiner

*Primary Examiner*—Peter Vo
*Assistant Examiner*—Sam Tawfik
(74) *Attorney, Agent, or Firm*—Greenblum & Bernstein, P.L.C.

(57) ABSTRACT

A roll and a process of making a roll for smoothing a web. The roll includes a roll core having an outer surface. A covering layer disposed on the outer surface of the roll core, the covering layer having an inner surface and an outer surface. The covering layer includes a resilient matrix material and fibers. The number of fibers varies radially from the inner surface to the outer surface of the covering layer. The process includes providing a roll core having an outer surface, and applying a covering layer on the outer surface of the roll core the covering layer having an inner surface and an outer surface. The covering layer includes a resilient matrix material and fibers, wherein the number of fibers varies radially from the inner surface to the outer surface of the covering layer.

48 Claims, 1 Drawing Sheet

RESILIENT ROLL AND PROCESS FOR PRODUCING SUCH A ROLL

CROSS-REFERENCE RELATED APPLICATIONS

The present application claims priority tinder 35 U.S.C. § 119 of German Patent Application No. 199 14 710.8, filed on Mar. 31, 1999, the disclosure of which is expressly incorporated by reference herein in its entirety.

BACKGROUND OF THE INVENTION

1. Field of the Invention

The present invention relates to a roll of the type used for smoothing paper webs. The roll has a hard roll core which can be a metal and an outside surface utilizing a resilient covering layer. The covering layer may be a resilient matrix material with fibers embedded in the matrix material. Furthermore, the invention is directed to a process for producing such a roll.

2. Discussion of Background Information

Resilient rolls of this type are typically used, for example, in the calendering of paper webs. Such calenders often use an elastic roll together with a hard roll in forming a press nip. The paper web is calendered by feeding it through one or more of these nips. The hard rolls generally have a very smooth surface and are made of, for example, steel or hard cast iron. They function in smoothing that side of the paper web which faces it. Resilient rolls which act on the opposite side of the paper web have the effect of evening and compacting the paper web in the press nip. The resilience of this second or opposite roll in the nip acts to limit intensive compaction of the paper web, which would lead to a specky appearance of the paper web. Such rolls are generally large and typically have lengths of from about 6 to 12 meters and diameters from about 800 to 1500 mm. Moreover, they are designed to withstand line forces up to approximately 600 N/mm and compressive stresses up to about 50 $N/mm^2$.

The tendency in paper manufacture is for calendering to be carried out on-line, that is to say the paper web leaving the papermaking machine or coating machine is led immediately through the paper smoothing device (calender). This design places high requirements or demands on the rolls of the calender or smoothing device. In particular, this design subjects the rolls to higher temperatures so that they are require to have temperature resistance. The high transport speeds of the paper web, necessitated by on-line operation, and the associated high rotational speeds of the calender rolls increase the alternating flexure frequency of the rolls. It is these factors which in turn leads to increased roll temperatures.

These high temperatures which are produced in on-line operation lead to problems which, in the case of conventional resilient rolls, can lead to the destruction of the synthetic covering. Such conventional synthetic coverings can function only with a maximum temperature differences of about 20° C. over the width of the roll. Moreover, the polymers normally used for the roll coating have a significantly higher coefficient of thermal expansion than the steel rolls or hard cast rolls normally used. Thus, when there is an increase in the temperature of the rolls, high axial stresses occur between the steel roll or hard cast roll and the synthetic coating which is connected to it.

Moreover, such rolls also experience high stresses in localized regions of the roll due to these regions being heated more so than surrounding areas. Such hot spots in the synthetic coating can cause the synthetic layer to separate or burst from the metal roll.

These hot spots can occur when, in addition to the mechanical stresses and the relatively high temperatures experienced by the rolls, there are crystallization points in the form, for example, of faulty adhesive bonds between the layer and the metal. Additionally, deposits or above-average bulges in the resilient covering which result from creases or foreign bodies on the paper web can produce these hot spots or crystallization points. In these cases, the temperature of these crystallization points often rises from normally about 80° C. to 90° C. to more than 150° C., which results in the aforementioned destruction of the synthetic layer.

SUMMARY OF THE INVENTION

The present invention provides a process for producing a resilient roll of the type mentioned at the beginning. Moreover, the invention is also directed to a corresponding roll. The roll of the invention is designed to withstand the formation or occurrence hot spots, with at least constant mechanical characteristics.

According to the invention, the roll utilizes a varied fiber content of the covering layer. The fiber content of the layer varies radially from the inside to the outside, and in particular, the fiber content is decreased from the inside to the outside of the layer. A corresponding process according to the invention provides for varying the fiber content of the covering layer in the radial direction, and in particular making the roll with a radially variable reduced fiber content so that the fiber content decreases from the inside to the outside.

Varying the fiber content of the covering layer radially from the inside to the outside results in a covering layer which has a coefficient of thermal expansion which, corresponding to the fiber content, differs in a radial direction from the inside to the outside. Since the matrix material usually has a considerably higher coefficient of thermal expansion than the fiber material used, the respective resulting coefficient of thermal expansion of the matrix material to which fibers have been added depends both on the coefficient of thermal expansion of the matrix material, to which fibers have been added, and that of the fibers. The more fibers which are embedded in the matrix material, the more similar the resulting coefficient of thermal expansion is to the coefficient of thermal expansion of the fibers used.

In this way, it is possible to adjust the coefficient of thermal expansion of the radially inner region of the covering layer by utilizing a relatively high fiber content. Thus, this inner region of the covering layer can be made so that it has the same order of magnitude coefficient of thermal expansion as that of the roll core. Accordingly, when the roll experiences heating from operation, the radially inner regions of the covering layer thus expand by essentially the same value as the roll core, so that high axial longitudinal stresses between the roll core and the covering layer are avoided or reduced significantly.

Since high fiber content also increases the stiffness of the covering layer considerably, the fiber content must be selected so that it is lower in the radially outer regions of the covering layer. Otherwise the surface of the roll may be too hard and would not be suitable for calendering. A fiber content which, in particular, decreases essentially continuously radially outwards within the covering layer provides the advantages of good calendering and a longer lasting roll. Thus, during roll heating, the longitudinal stresses which typically occur within the covering layer and which are produced because of the different thermal expansion of the various regions of the covering layer, do not become so great at any point that detachment or destruction of the covering layer arises.

According to one embodiment of the invention, a roll is provided in which, in the radially outer region of the covering layer, the fiber content is essentially zero. This means that the surface of the roll is as resilient as possible and, following an appropriate grinding operation, has a very smooth surface. In this embodiment, all of the fibers present in the covering layer are disposed within the covering layer, but do not reach as far as the surface of the covering layer. This design allows the surface of the roll to be reground after a certain running time without the fibers present in the matrix material emerging from the covering layer after the grinding operation.

The nip may also be adjusted to operate efficiently with the desired fiber content of the roll cover. In the case of a roll having a very resilient cover, the hard mating roll may be impressed more intensely into the soft covering of the elastic roll. This can result in the width of the nip in the running direction of the paper web becoming greater the more resilient the outer side of the covering layer of the elastic roll is. Thus, by setting a specific fiber content variation and in particular a specific fiber content at the surface of the covering layer, a desired nip width can be produced.

According to another embodiment of the invention, the covering layer comprises a radially outer functional layer and a radially inner connecting layer which connects the functional layer to the roll core. In this embodiment, the connecting layer, like the functional layer, can include a resilient matrix material and fibers embedded in the matrix material. The matrix material of the connecting layer and of the functional layer can preferably be the same material and, in particular, the fibers of the connecting layer and of the functional layer can also utilize the same fiber material. As a result of making the covering layer this way, the characteristics of the roll cover can be adapted in a more optimum fashion to the respective mechanical and thermal requirements. Thus, in principle, for example, the matrix material of the connecting layer and of the functional layer can be different. Moreover, the fiber material used within the functional layer and the connecting layer can also differ. For example, the invention provides that the matrix material of the connecting layer may be wound onto the roll core in fiber bundles or so-called fiber rovings, that is to say in flat fiber tapes which each consist of fibers of identical type, while the fibers of the functional layer may be wound onto the connecting layer in the form of a fibrous non-woven form.

The fiber content of the connecting layer is preferably made higher than the fiber content of the functional layer. In this way, the connecting layer is dominated by fibers so that the coefficient of thermal expansion of the connecting layer is predominately determined by the coefficient of thermal expansion of the fibers. As a result, the resulting coefficient of thermal expansion of the connecting layer can be matched to the coefficient of thermal expansion of the roll core.

According to still another embodiment of the invention, the fibers are distributed radially, essentially uniformly, over the connecting layer. In particular, the fiber content of the connecting layer can vary radially from the inside to the outside and preferably decreasing from the inside to the outside. As already described in relation to the functional layer, this prevents the situation where longitudinal stresses, which can occur in the event of heating, are distributed uniformly over the radial extent of the covering layer. Accordingly, the longitudinal stresses, which lead to damage to the covering layer, do not occur at any point.

According to a further embodiment, the fiber content of the connecting layer, in its radially outer region, is essentially as high as the fiber content of the functional layer in its radially inner region. As a result, with regard to the thermal expansion, a continuous transition between the connecting layer and the functional layer is created. Moreover, this design produces a stress-optimized connection in this transition region as well. The fibers are preferably arranged in radially mutually spaced fiber layers. Ideally, the spacing between radially outer adjacent fiber layers should be greater than the spacing between radially inner fiber layers. The resilient matrix material present between the fiber layers achieves the situation where the covering layer maintains a certain resilience in the longitudinal direction, so that the longitudinal expansions which occur in the event of heating can be compensated for well.

The fiber content of the connecting layer is can be in the range of approximately 40 to approximately 70% by volume. It is preferred that it is in the range of approximately 50 to approximately 70% by volume, and in particular from approximately 50 to approximately 60% by volume, and most preferably approximately 55% by volume. The fiber content of the connecting layer determines both its stiffness and thermal conductivity and also the overall coefficient of expansion. Thus, the relatively high fiber content also achieves a high thermal conductivity of the connecting layer, so that the heat from overheating points which can occur during operation, can rapidly be dissipated axially to the outside. This prevents the formation of hot spots.

As opposed to a connecting layer, the fiber content of the functional layer is preferably in the range of approximately 5 to approximately 20% by volume, and most preferably in the range of approximately 8 to approximately 12% by volume. As a result of this reduced fiber content, the functional layer has a lower stiffness than the connecting layer. This is necessary for evening and compacting the paper web which is treated during calendering. If, because of the reduced fiber content, the coefficient of thermal expansion of the functional layer becomes too high, this coefficient can be reduced by an appropriate addition of fillers to the matrix material of the functional layer.

The invention therefore provides for a roll for smoothing a web including a roll core having an outer surface, and a covering layer disposed on the outer surface of the roll core, the covering layer having an inner surface and an outer surface, the covering layer comprising a resilient matrix material and fibers, wherein the number of fibers varies radially from the inner surface to the outer surface of the covering layer. The web may be a paper web. The roll core may comprise a hard metal roll core. The fibers may be embedded in the matrix material. The number of fibers near the inside surface may be greater than the number of fibers near the outside surface. The number of fibers may be greatest near the inside surface and gradually decreases to substantially none near the outside surface. A region of the covering layer near the outer surface may comprise substantially no fibers. The covering layer may comprise a functional layer and a connecting layer disposed radially inward of the functioning layer. The connecting layer may connect the functional layer to the roll core. The connecting layer may comprise a resilient matrix material and fibers embedded in the resilient matrix material. The functional layer may comprise a resilient matrix material, the resilient matrix material of the connecting layer and of the functional layer comprising the same material. The fibers of the connecting layer and of the functional layer may comprise the same fiber material. A fiber content of the connecting layer may be higher than a fiber content of the functional layer. The connecting layer may comprise a plurality of distinct fiber layers which are arranged to be radially concentric about an axis of the roll core.

A fiber content of the connecting layer may vary radially from an inside surface of the connecting layer to an outside surface of the connecting layer. The functional layer may comprise a plurality of distinct fiber layers which are arranged to be radially concentric about an axis of the roll core. A fiber content of the functional layer may vary radially from an inside surface of the functional layer to an outside surface of the functional layer. A fiber content of the connecting layer in an outer surface region of the connecting layer may substantially correspond to a fiber content of an inner surface region of the functional layer. The connecting layer may comprise a plurality of distinct fiber layers. The distinct fiber layers of the connecting layer may comprise substantially similar thicknesses. The distinct fiber layers of the functional layer may comprise substantially similar thicknesses. Alternatively, the distinct fiber layers of the connecting layer may comprise substantially different thicknesses. The distinct fiber layers of the functional layer may comprise substantially different thicknesses.

The at least one distinct fiber layer of the functional layer may have a greater thickness than at least one distinct fiber layer of the connecting layer. An average fiber content of the functional layer may be in the range of approximately 5 to approximately 20% by volume. The average fiber content of the functional layer may be in the range of approximately 5 to approximately 12% by volume. An average fiber content of the connecting layer may be in the range of approximately 40 to approximately 70% by volume. The average fiber content of the connecting layer may be in the range of approximately 50 to approximately 60% by volume. The average fiber content of the connecting layer may be approximately 55% by volume. The fibers may comprise one of glass fibers, carbon fibers, and a mixture of glass fibers and carbon fibers. The matrix material may comprise one of a polymer, a thermosetting polymer, and a thermoplastic polymer. The matrix material may comprise a mixture of a resin and a hardener.

The invention also provides for a process for making a roll for smoothing a web including providing a roll core having an outer surface, and applying a covering layer on the outer surface of the roll core, the covering layer having an inner surface and an outer surface, the covering layer comprising a resilient matrix material and fibers, wherein the number of fibers varies radially from the inner surface to the outer surface of the covering layer. The web may be is a paper web. The roll core may comprise a hard metal roll core. The fibers may be embedded in the matrix material. The number of fibers near the inside surface may be greater than the number of fibers near the outside surface. The number of fibers may be greatest near the inside surface and gradually decreases to substantially none near the outside surface. The applying may comprise winding at least one fiber bundle comprising a large number of fibers onto the roll core. The winding may comprise forming a plurality of distinct fiber layers which are separated by matrix material. The at least one fiber bundle may comprise at-least one fiber roving. The at least one fiber roving may comprise a large number of fibers of identical type disposed adjacent one another. The at least one fiber bundle may be formed comprises a non-woven fiber. The winding may further comprise coating the at least one fiber bundle with matrix material. The coating may comprise exposing the at least one fiber bundle to a bath of matrix material. The at least one fiber bundle may be essentially wound dry onto the roll core. Either during or after the winding operation, the matrix material may be applied to the wound fiber bundle so that the fiber bundle is one of completely embedded in the matrix material and completely covered by the matrix material. The fibers may comprise one of glass fibers, carbon fibers, and a mixture of glass fibers and carbon fibers.

The invention also provides for a roll for smoothing a web including a hard metal roll core having an outer surface, and a resilient covering layer having an inner surface region, a middle region, and an outer surface region, the inner surface region being affixed to the outer surface of the hard metal roll core, the resilient covering layer comprising a resilient resin matrix material and a plurality of one of glass fibers and carbon fibers embedded in the matrix material, wherein the outer surface region the resilient covering layer comprises substantially no fibers, the middle region comprises some fibers, and the inner surface region comprises more fibers than the middle region.

Moreover, the invention also provides for a process for making a roll for smoothing a web including providing a hard metal roll core having an outer surface, and applying a resilient covering layer having an inner surface region, a middle region, and an outer surface region, to the outer surface of the hard metal roll core, the resilient covering layer comprising a resilient resin matrix material and a plurality of one of glass fibers and carbon fibers embedded in the matrix material, wherein the outer surface region the resilient covering layer comprises substantially no fibers, the middle region comprises some fibers, and the inner surface region comprises more fibers than the middle region.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and to wherein.

DETAILED DESCRIPTION OF THE INVENTION

Figure 1:
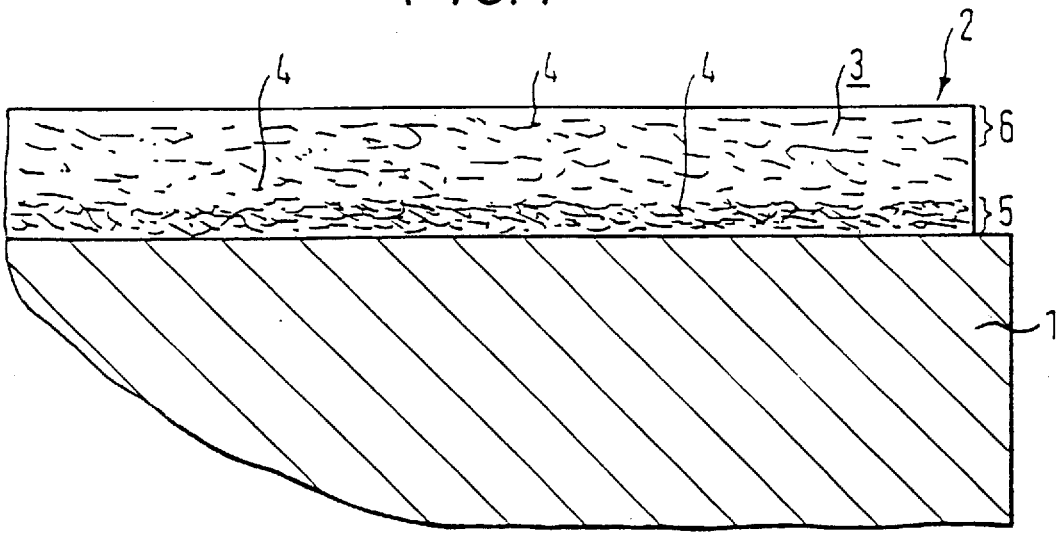
FIG. 1 shows a partial longitudinal section through a roll constructed in accordance with the invention with a resilient covering layer.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. FIG. 1 shows part of a roll core I which is sectioned in the longitudinal direction. Roll core 1 can be made of steel for example and is provided on its outer surface with a resilient covering layer 2, likewise illustrated in section.

Covering layer 2 comprises a resilient matrix material 3, which can be a resin/hardener combination, in which a large number of fibers 4 are embedded. The fibers 4 can be, for example, carbon fibers or glass fibers or a mixture of carbon and glass fibers. Moreover, other conventional fibers may also be utilized.

By utilizing fibers 4, the stiffness of covering layer 2 can be increased when compared to a covering layer which is made of a pure polymer having no fibers. Moreover, the addition of these fibers, and in particular carbon fibers, improves the thermal conductivity of covering layer 2.

Further, FIG. 1 illustrates one embodiment where the fiber content in radially inner region 5 of covering layer 2 is considerably higher than in its radially outer region 6. This produces a covering layer 2 with a more resilient radially outer region 6 when compared to radially inner region 5. As a result, when resilient roll is interacting with a hard roll in a nip press, the hard roll is allowed to press relatively far into the resilient outer surface of covering layer 2 and this produces a press nip which is long in the circumferential direction, i.e., an extended nip.

Furthermore, the coefficient of thermal expansion of covering layer 2 is also essentially determined at the same time by varying the amount and type of fibers 4. Since metallic roll core 1 usually has a considerably lower coefficient of thermal expansion than matrix material 3, matrix material 3 expands considerably more in the axial direction than roll core 1 when both are heated during operation. However, by adding even more fibers 4, whose coefficient of thermal expansion is of the order of magnitude of the coefficient of thermal expansion of the roll core 1, in region 5 of covering layer 2, the resulting coefficient of thermal expansion of region 5 can be made similar to that of roll core 1. As a result of this design, when the roll experiences heating, region 5 expands in the axial direction by a similar value or amount to that of roll core 1, so that longitudinal stresses which typically occur axially are largely avoided.

The fiber content within covering layer 2 should essentially decrease continuously radially towards the outside as shown in FIG. 1. This ensures that within covering layer 2, the longitudinal stresses which occur in the event of heating, have only low values in the radial course located near the outside surface. Moreover, such values can be absorbed by the resilience of matrix material 3.

Figure 2:
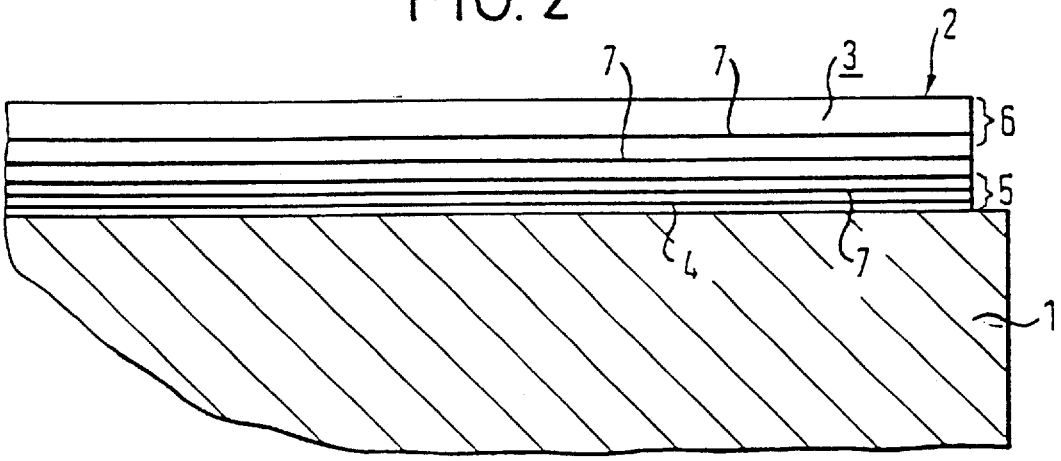
FIG. 2 shows a further embodiment of a roll constructed in accordance with the invention in a partial longitudinal section.

In the embodiment illustrated in FIG. 2, fibers 4 within matrix material 3 are illustrated schematically as distinct fiber layers 7 which essentially run concentrically about a center axis of roll core 1.

In this case, fiber layers 7 can be produced for example by winding fiber rovings onto roll core 1. To form the various layers 7, a number of winding procedures can be carried out in order to form a complete covering layer 2 having the desired number of fiber layers 7. Of course, the invention contemplates other conventional techniques, besides winding, for applying the various layers of fiber 4.

Before the winding operation, the fibers or fiber rovings can have matrix material 3 in a liquid state applied to them. This may be done for example, by drawing the fibers or fiber rovings through a bath of matrix. However, it is also possible for the fibers or the fiber rovings to be wound dry onto roll core 1 and/or to be impregnated with matrix material 3 during or after the winding operation. This may be done until they are completely surrounded by matrix material 3.

In the radially inner region 5 of covering layer 2, fiber layers 7 can have relative spacing in the radial direction which is considerably lower or less than in radially outer region 6. Preferably, very few or no fibers are present in the outermost region of covering layer 2, that is to say that in this region only pure matrix material 3 is present.

In order to achieve the smoothest possible roll surface, after the winding procedure, the uppermost layer of matrix material 3 should be subjected to grinding to remove irregularities. Since, the invention provides for a roll cover having a fiber-free configuration on radially outer region 6 of covering layer 2, no fibers 4 will be exposed on the outer surface of covering layer 2 even after it is subjected to multiple re-grinding steps. This design provides for a surface that has an optimum smoothness.

Figure 3:
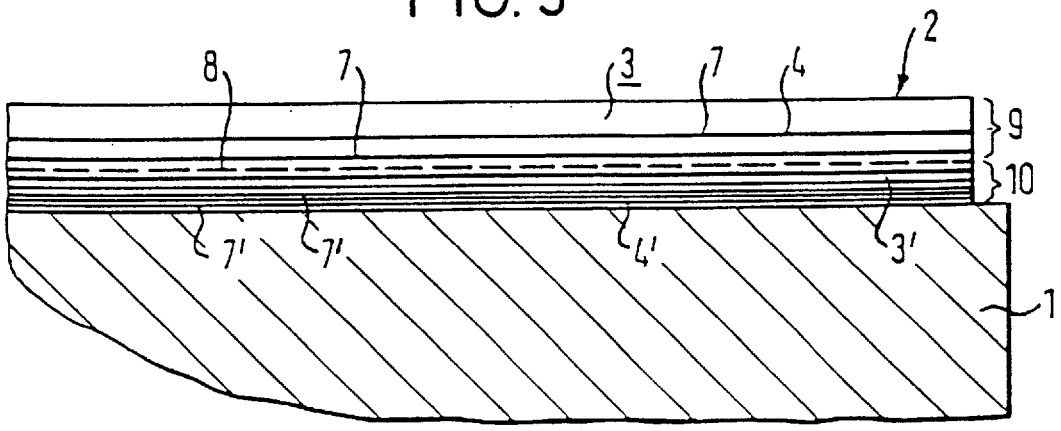
FIG. 3 shows a third embodiment of a roll constructed in accordance with the invention in partial longitudinal section.

In the embodiment illustrated in FIG. 3, covering layer 2 is subdivided into a radially outer functional layer or section 9 and a radially inner connecting layer or section 10. Thus, connecting layer 10 functions to connect functional layer 9 to roll core 1 as is illustrated by dashed line 8.

Both functional layer 9 and connecting layer 10 comprise a matrix material 3 and 3' respectively. Fiber layers 7 and 7' are embedded therein such that both matrix material 3 and 3' and fiber material 4 and 4' form fiber layers 7 and 7'. The choice of the design and number of such layers is preferably selected so as to be identical or very similar, in each case. In principle, however, it is possible to use different materials if this meets the desired requirements better.

The invention also contemplates an embodiment wherein fiber layers 7' of connecting layer 10 are produced by winding fiber rovings while fiber layers 7 of functional layer 9 are produced by winding a fiber which is non-woven. In using a non-woven fiber, the fibers are usually distributed non-uniformly and are shorter than is the case when winding fiber rovings. If a non-woven fiber is used, functional layer can have a higher flexibility than would be the case if fiber rovings were used.

Furthermore, as a result of using a non-woven fiber, for example by comparison with the embodiment illustrated in FIG. 1, the tensile strength and the thermal conductivity of functional layer 9 can be improved, since the fibers of the non-woven fiber are more intensively inter-engaged.

.It should be noted that while only relatively few fiber layers 7 are shown in FIGS. 2 and 3, the invention also contemplates a covering layer 9 having between approximately 10 and 90 fiber layers, and preferably between about 40 and 50 fiber layers. Of course, the number of layers may be tailored to the requirements of the calender and web processing.

Moreover, although connecting layer 10 can have a lower overall thickness than functional layer 9, as a result of the closer arrangement of fiber layers 7', the invention contemplates a cover where the number of fiber layers 7' used in connecting layer 10 can be similar to the number of fiber layer 7 of functional layer 9. A typical thickness for connecting layer 10 can be in the range of from approximately 3 to approximately 10 mm, while functional layer 9 can have a thickness in the range of from approximately 5 to approximately 20 mm.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A roll for smoothing a web comprising:

a roll core having an outer surface; and a covering layer disposed on the outer surface of the roll core, the covering layer having an inner surface and an outer surface;

the covering layer comprising a resilient matrix material and fibers, wherein the number of fibers varies radially from the inner surface to the outer surface of the covering layer, and wherein the number of fibers near the inside surface is greater than the number of fibers near the outside surface.

2. The roll of claim 1, wherein the web is a paper web.

3. The roll of claim 1, wherein the roll core comprises a hard metal roll core.

4. The roll of claim 1, wherein the fibers are embedded in the matrix material.

5. The roll of claim 1, wherein the number of fibers is greatest near the inside surface and gradually decreases to substantially none near the outside surface.

6. The roll of claim 1, wherein a region of the covering layer near the outer surface comprises substantially no fibers.

7. The roll of claim 1, wherein the covering layer comprises a functional layer and a connecting layer disposed radially inward of the functioning layer.

8. The roll of claim 7, wherein the connecting layer connects the functional layer to the roll core.

9. The roll of claim 8, wherein the connecting layer comprises a resilient matrix material and fibers embedded in the resilient matrix material.

10. The roll of claim 9, wherein the functional layer comprises a resilient matrix material, the resilient matrix material of the connecting layer and of the functional layer comprising the same material.

11. The roll of claim 10, wherein the fibers of the connecting layer and of the functional layer comprise the same fiber material.

12. The roll of claim 11, wherein a fiber content of the connecting layer is higher than a fiber content of the functional layer.

13. The roll of claim 8, wherein the connecting layer comprises a plurality of distinct fiber layers which are arranged to be radially concentric about an axis of the roll core.

14. The roll of claim 13, wherein a fiber content of the connecting layer varies radially from an inside surface of the connecting layer to an outside surface of the connecting layer.

15. The roll of claim 8, wherein the functional layer comprises a plurality of distinct fiber layers which are arranged to be radially concentric about an axis of the roll core.

16. The roll of claim 15, wherein a fiber content of the functional layer varies radially from an inside surface of the functional layer to an outside surface of the functional layer.

17. The roll of claim 16, a fiber content of the connecting layer in an outer surface region of the connecting layer substantially corresponds to a fiber content of an inner surface region of the functional layer.

18. The roll of claim 8, wherein the connecting layer comprises a plurality of distinct fiber layers.

19. The roll of claim 18, wherein the distinct fiber layers of the connecting layer comprise substantially similar thicknesses.

20. The roll of claim 18, wherein the distinct fiber layers of the functional layer comprise substantially similar thicknesses.

21. The roll of claim 18, wherein the distinct fiber layers of the connecting layer comprise substantially different thicknesses.

22. The roll of claim 21, wherein the distinct fiber layers of the functional layer comprise substantially different thicknesses.

23. The roll of claim 18, wherein the at least one distinct fiber layer of the functional layer has a greater thickness than at least one distinct fiber layer of the connecting layer.

24. The roll of claim 8, wherein an average fiber content of the functional layer is in the range of approximately 5 to approximately 20% by volume.

25. The roll of claim 24, wherein the average fiber content of the functional layer is in the range of approximately 8 to approximately 12% by volume.

26. The roll of claim 8, wherein an average fiber content of the connecting layer is in the range of approximately 40 to approximately 70% by volume.

27. The roll of claim 26, wherein the average fiber content of the connecting layer is in the range of approximately 50 to approximately 60% by volume.

28. The roll of claim 27, wherein the average fiber content of the connecting layer is approximately 55% by volume.

29. The roll of claim 1, wherein the fibers comprise one of glass fibers, carbon fibers, and a mixture of glass fibers and carbon fibers.

30. The roll of claim 1, wherein the matrix material comprises one of a polymer, a thermosetting polymer, and a thermoplastic polymer.

31. The roll of claim 1, wherein the matrix material comprises a mixture of a resin and a hardener.

32. A process for making a roll for smoothing a web comprising:

providing a roll core having an outer surface; and applying a covering layer on the outer surface of the roll core, the covering layer having an inner surface and an outer surface, the covering layer comprising a resilient matrix material and fibers, wherein the number of fibers varies radially from the inner surface to the outer surface of the covering layer, and wherein the number of fibers near the inside surface is greater than the number of fibers near the outside surface.

33. The process of claim 32, wherein the web is a paper web.

34. The process of claim 32, wherein the roll core comprises a hard metal roll core.

35. The process of claim 32, wherein the fibers are embedded in the matrix material.

36. The process of claim 32, wherein the number of fibers is greatest near the inside surface and gradually decreases to substantially none near the outside surface.

37. The process of claim 32, wherein the applying comprises winding at least one fiber bundle comprising a large number of fibers onto the roll core.

38. The process of claim 37, wherein the winding comprises forming a plurality of distinct fiber layers which are separated by matrix material.

39. The process of claim 37, wherein the at least one fiber bundle comprises at least one fiber roving.

40. The process of claim 39, wherein the at least one fiber roving comprises a large number of fibers of identical type disposed adjacent one another.

41. The process of claim 37, wherein the at least one fiber bundle formed comprises a non-woven fiber.

42. The process of claim 37, wherein the winding further comprises coating the at least one fiber bundle with matrix material.

43. The process of claim 42, wherein the coating comprises exposing the at least one fiber bundle to a bath of matrix material.

44. The process of claim 37, wherein the at least one fiber bundle is essentially wound dry onto the roll core.

45. The process of claim 44, wherein either during or after the winding operation, the matrix material is applied to the wound fiber bundle so that the fiber bundle is one of completely embedded in the matrix material and completely covered by the matrix material.

46. The process of claim 32, wherein the fibers comprise one of glass fibers, carbon fibers, and a mixture of glass fibers and carbon fibers.

47. A roll for smoothing a web comprising:

a hard metal roll core having an outer surface; and a resilient covering layer having an inner surface region, a middle region, and an outer surface region, the inner surface region being affixed to the outer surface of the hard metal roil core;

the resilient covering layer comprising a resilient resin matrix material and a plurality of one of glass fibers and carbon fibers embedded in the matrix material, wherein the outer surface region of the resilient covering layer comprises substantially no fibers, the middle region comprises some fibers, and the inner surface region comprises more fibers than the middle region.

48. A process for making a roll for smoothing a web comprising:

providing a hard metal roll core having an outer surface; and applying a resilient covering layer having an inner surface region, a middle region, and an outer surface region, to the outer surface of the hard metal roll core;

the resilient covering layer comprising a resilient resin matrix material and a plurality of one of glass fibers and carbon fibers embedded in the matrix material, wherein the outer surface region the resilient covering layer comprises substantially no fibers, the middle region comprises some fibers, and the inner surface region comprises more fibers than the middle region.

* * * * *